US006666141B2

(12) United States Patent
Hagerty

(10) Patent No.: US 6,666,141 B2
(45) Date of Patent: Dec. 23, 2003

(54) VARIABLE INCREMENT MODULAR ARTILLERY PROPELLANT

(75) Inventor: Patrick E. Hagerty, St. Paul, MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 09/902,068

(22) Filed: Jul. 9, 2001

(65) Prior Publication Data

US 2003/0005845 A1 Jan. 9, 2003

(51) Int. Cl.[7] ..... F42B 5/38
(52) U.S. Cl. ..... 102/282; 102/317; 102/431
(58) Field of Search ..... 102/317, 431, 102/282

(56) References Cited

U.S. PATENT DOCUMENTS

| | | | | | |
|---|---|---|---|---|---|
| 2,697,399 | A | * | 9/1954 | McAdams | 102/317 |
| 2,921,519 | A | * | 1/1960 | Martin | 102/317 |
| 3,057,296 | A | * | 10/1962 | Silverman | 102/317 |
| 3,332,349 | A | * | 7/1967 | Schwoyer et al. | 102/317 |
| 3,357,355 | A | * | 12/1967 | Roush | 102/317 X |
| 4,284,006 | A | * | 8/1981 | Davis | 102/317 |
| 4,313,380 | A | * | 2/1982 | Martner et al. | 102/317 X |
| 5,282,423 | A | * | 2/1994 | Sikorski et al. | 102/431 |
| 5,417,162 | A | * | 5/1995 | Adams et al. | 102/317 |

* cited by examiner

*Primary Examiner*—Michael J. Carone
(74) *Attorney, Agent, or Firm*—Ronald C. Kamp

(57) ABSTRACT

A proportional modular assembly of two charges for use in a gun, which charges are structured so that the power of one charge is related to the power of the other charge by a ratio of integers.

1 Claim, 3 Drawing Sheets

TABLE I

FIG. 4

| PROPELLANT POWER: (ZONE) | $1\frac{1}{2}$ | $1\frac{3}{4}$ | 2 | $2\frac{1}{4}$ | $2\frac{1}{2}$ | $2\frac{3}{4}$ | 3 | $3\frac{1}{4}$ | $3\frac{1}{2}$ | $3\frac{3}{4}$ | 4 | $4\frac{1}{4}$ | $4\frac{1}{2}$ | $4\frac{3}{4}$ | 5 | $5\frac{1}{4}$ | $5\frac{1}{2}$ | $5\frac{3}{4}$ | 6 |
|---|---|---|---|---|---|---|---|---|---|---|---|---|---|---|---|---|---|---|---|
| # OF "A" (FULL SIZE) MODULES | 0 | 1 | 2 | 0 | 1 | 2 | 3 | 1 | 2 | 3 | 4 | 2 | 3 | 4 | 5 | 3 | 4 | 5 | 6 |
| # OF "B" (3/4 SIZE) MODULES | 2 | 1 | 0 | 3 | 2 | 1 | 0 | 3 | 2 | 1 | 0 | 3 | 2 | 1 | 0 | 3 | 2 | 1 | 0 |
| TOTAL # OF MODULES | 2 | 2 | 2 | 3 | 3 | 3 | 3 | 4 | 4 | 4 | 4 | 5 | 5 | 5 | 5 | 6 | 6 | 6 | 6 |

TABLE II

FIG. 5

| PROPELLANT POWER: (ZONE) | $1\frac{1}{3}$ | $1\frac{2}{3}$ | 2 | $2\frac{1}{3}$ | $2\frac{2}{3}$ | 3 | $3\frac{1}{3}$ | $3\frac{2}{3}$ | 4 | $4\frac{1}{3}$ | $4\frac{2}{3}$ | 5 | $5\frac{1}{3}$ | $5\frac{2}{3}$ | 6 |
|---|---|---|---|---|---|---|---|---|---|---|---|---|---|---|---|
| # OF "A" (FULL SIZE) MODULES | 0 | 1 | 2 | 1 | 2 | 3 | 2 | 3 | 4 | 3 | 4 | 5 | 4 | 5 | 6 |
| # OF "B" (2/3 SIZE) MODULES | 2 | 1 | 0 | 2 | 1 | 0 | 2 | 1 | 0 | 2 | 1 | 0 | 2 | 1 | 0 |
| TOTAL # OF MODULES | 2 | 2 | 2 | 3 | 3 | 3 | 4 | 4 | 4 | 5 | 5 | 5 | 6 | 6 | 6 |

VARIABLE INCREMENT MODULAR ARTILLERY PROPELLANT

FIELD OF THE INVENTION

The present invention provides an optimally modular and proportionately structurable packaging system and method for composing propellant charges without undue limitations on the number of zones (power or amounts of propellant needed for a particular shot) that can be fired. The invention is a method and system for packaging solid explosive artillery propellant in proportional amounts. Modules in the proportions specified by this invention can be combined to compose a total amount of loaded propellant that is nearly optimum for shooting at a specific target. One of the unique aspects of this invention includes its teachings that a sufficiently large number of zones could be composed using only two different sizes of charge containers thereby providing efficiency and ease in handling, shipping, and manufacturing.

DESCRIPTION OF THE PRIOR ART

Artillery projectiles are fired using total amounts of propellant that are selected to reach a designated target along a predetermined trajectory with a specific projectile type. Different guns use different kinds of propellant; for example: liquid propellant, bags of solid propellant, and rigid canisters of solid propellant. For a specific gun and propellant type, the amount of propellant used for a given shot, the zone, varies depending upon the distance to the target and the shape of the desired trajectory. Liquid propellant guns. allow a nearly infinite number of zones by metering the amount of liquid used. Liquid propellant guns are therefore theoretically capable of firing whatever trajectory is optimum to engage the target. Contemporary solid propellant systems are not as flexible. Because solid propellant is manufactured in uniformly sized modules, such as bags or combustible canisters, the number of different zones that can be fired is comparatively small. One or more modules of propellant are loaded prior to shooting the gun. Modules are indivisible and only complete modules can be loaded. Hence solid propellant guns must shoot along trajectories limited by the zones available. These result from using an integral number of modules (of the order of two to six), and these are not always the optimum shots.

SUMMARY OF THE INVENTION

The present invention achieves flexibility and adaptability to a variety of zones for solid propellants. The VIMAP structure provides a modular system of charge increments that can be assembled to compose different zones. The invention permits a module-based increment to be packaged in different ways, for example combustible canisters or bags. Specifically, various zones of total propellant power are constructed using two different module sizes. The modules are manufactured so that their propellant power is in the ratio of two consecutive integers greater than one. For example, the consecutive integers may be 2 and 3 or 3 and 4. In other words, an arrangement based on the integers 2 and 3 shall yield a smaller module that is ⅔ the propellant power of the larger. Similarly, if based on the integers 3 and 4, the smaller module shall be ¾ of the propellant power of the larger. Such modules would be combined in different arrangements to compose numerous zones.

BRIEF DESCRIPTION OF THE DRAWINGS

FIG. 4 Labeled Table I shows the zones that can be constructed from combinations of A and B modular charge increments that can be expressed by the integers 3 and 4. The power of an A-Module is equal to unity. The B-Module power is ¾.

FIG. 5 Labeled Table II shows the zones that can be constructed by combinations of A and B modular charge increments that can be expressed by the integers 2 and 3. The power of an A-Module is equal to one and the B-Module is ⅔.

DESCRIPTION OF THE PREFERRED EMBODIMENT

Figure 1:
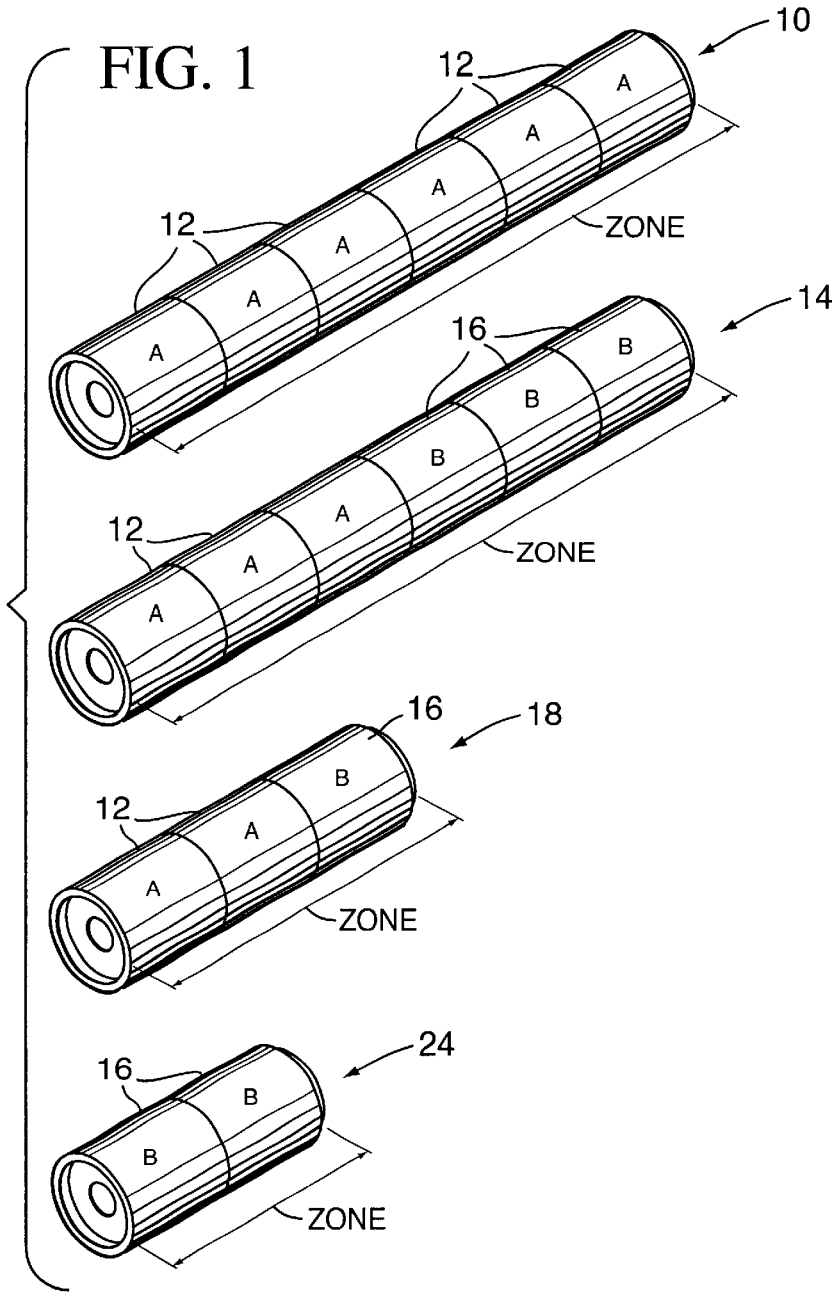
FIG. 1 is a perspective view of typical module assemblies, A and B, based on the integers 3 and 4. The propellant power of A-Module is considered to be unity and propellant B-Module is ¾. The assemblies indicate, for sample purposes, various arrangements and combinations of the Modules A and B.

The present invention provides a large number of combinations to yield different zones by utilizing only two sizes. Because propellant is dangerous to handle and difficult to measure precisely, the power of a module is fixed when it is manufactured. Once built, modules cannot be subdivided to obtain smaller charges. Further, a major reduction in module physical size is precluded by handling and structural concerns.

Heretofore, unicharge systems could only fire a limited number of zones corresponding to a fixed number of modules. Zone 1 would use 1 module, zone 2 used 2 modules, etc. An optimum shot might require an intermediate zone such as 1½. Such shots are impossible in present systems and a suboptimal shot (e.g., either zone 1 or zone 2) would be fired instead. The present invention overcomes these and other limitations as discussed hereinbelow.

FIG. 1 shows how Variable Increment Modular Artillery Propellent (VIMAP) modules consisting of two sizes can be combined to obtain different zones. A module structure 10 is composed of 6 A-Module 12. The A-Module 12 represents a unit of charge. Thus, the A-Module 12 provides a specified propellant with a known capability. In module structure 10 the six A-Module 12 compose a zone 6 assembly. Similarly, module structure 14 is composed of A-Modules 12 and B-Modules 16. The power of a B-Module 16 is related to the power of an A-Module 12 by a ratio of integers such as ⅔ or ¾. Thus, the module structure 14 provides three unitary A-Modules 12 and three fractional B-Modules 16. When the fraction for B-Modules is ¾, then assembly 14 represents a total propellant zone of 5¼; i.e., 1+1+1+¾+¾+¾. Further module structure 18 is composed of two A-Modules 12 and one B-Module 16. Additionally, Module structure 24 is composed entirely of B-Modules 16.

Figure 2:
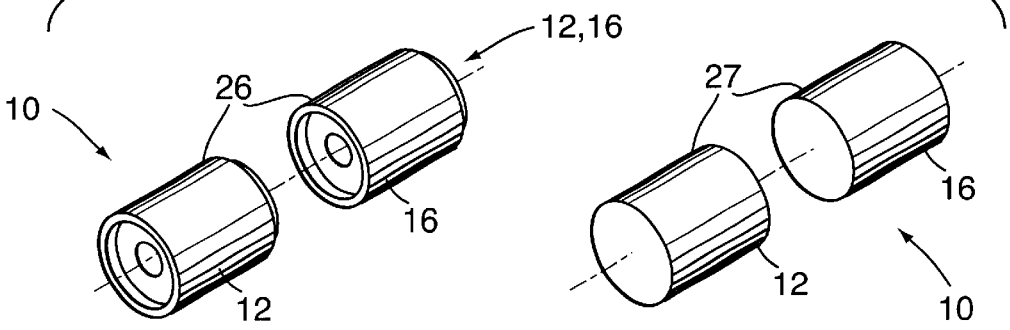
FIG. 2 is a perspective view of basic modules showing interlocking canisters and bags of charge.

FIG. 2 shows how modules are combined to form a system. In the preferred embodiment, an A-Module 12 and a B-Module 16 are composed by interlocking combustible case canisters 26 to thereby form a module structure 10. An alternate embodiment shows an A-Module 12 and a B-Module 16 packaged in semi-rigid bags 27 to form the module structure 10.

Figure 3:
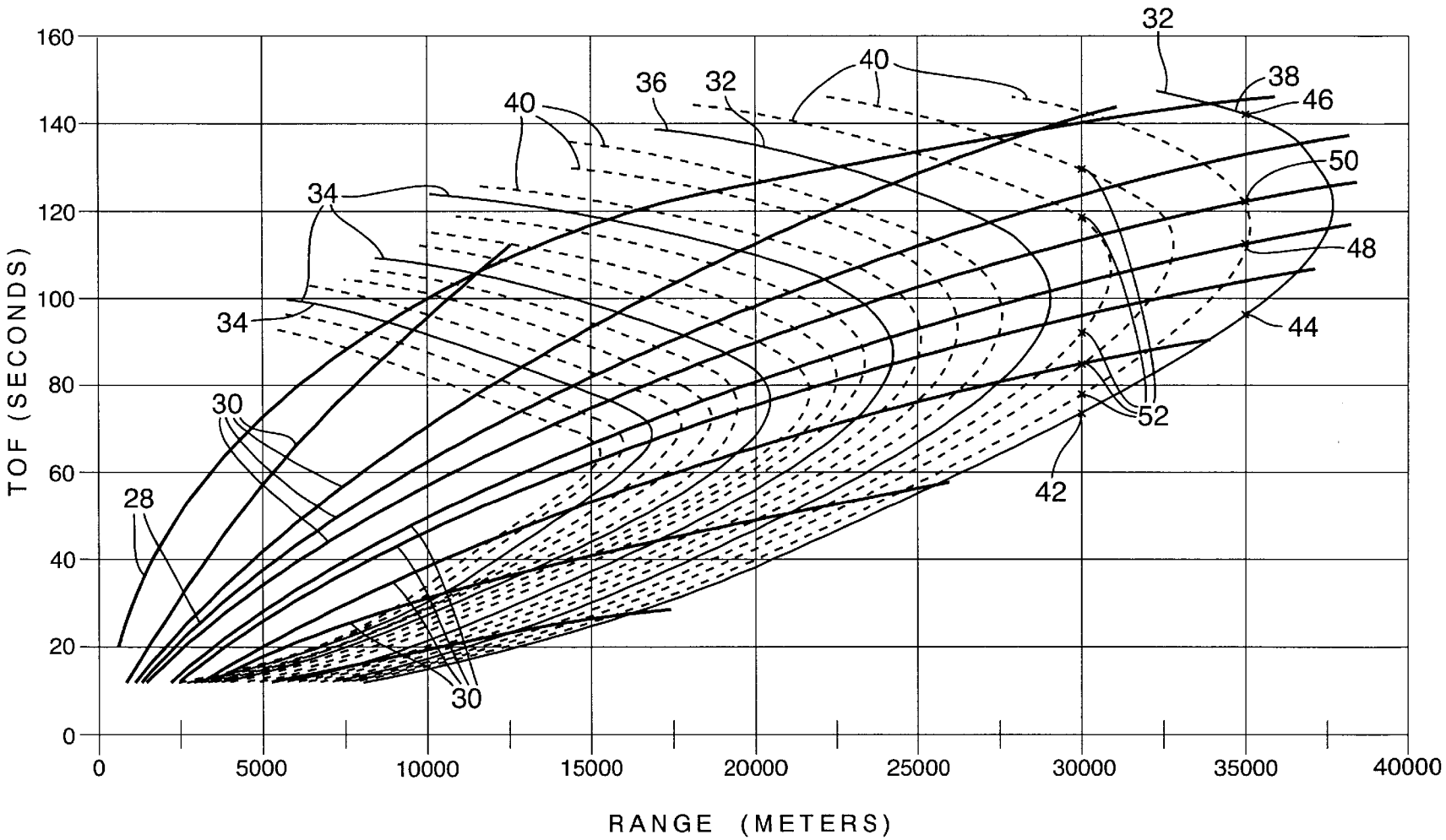
FIG. 3 is a graphical representation of the flight characteristics of a typical artillery projectile (the M549). A specific trajectory is a single point on this graph; its time of flight (TOF) is indicated on the vertical axis and the range to the target is indicated on the horizontal axis. Each broken line represents the locus of trajectories that can be achieved for a specific muzzle velocity. The muzzle velocity of a given shot is determined by the propellant zone used to fire it.

FIG. 3 is a graphical representation of the flight characteristics of a typical artillery projectile (the M549). A specific trajectory is a single point on this graph. The time of flight (TOF) of a projectile is indicated on the vertical axis. Each line 30 represents the set of trajectories fired at a constant quadrant elevation (the angle between the horizontal and the barrel of the gun or cannon from which the projectile is being fired). The highest and lowest practical quadrant elevation (QE) depend upon the projectile's aerodynamics and these are shown by curves 28.

The solid curved lines 32 and the dotted curved lines 40 are curves of constant muzzle velocity. The muzzle velocity required for a given shot can be determined by interpolating between these lines.

A cannon can generally fire at any QE between its upper and lower limits, however, it can only achieve muzzle velocities defined by the zones its propellant can generate. The lines 32 represent the muzzle velocities that can be achieved with a typical system of one fixed size for the modules of charge. The line 34 represents zone 2 (consisting of two modules of charge) and the rightmost line 38 represents zone 6 (6 modules of charge) Zone 1 is not used in practice because it does not provide enough impetus to guarantee that the projectile will leave the barrel of the cannon. Other points on the graph represent shots that could be fired by some other cannon, but such shots cannot be fired by a cannon whose projectile propulsion system has zones given by the lines 30.

The dotted lines 40 represent the locus of additional trajectories that can be fired by a cannon implementing the VIMAP system with modules in the ratio of 3 to 4. The dotted lines 40 lying between the zone 5 line 36 and the zone 6 line 38 represents zones of propellant powers (zones) 5¼, 5½ and 5¾. The addition of these intermediate zones substantially increases the number of different trajectories that can be fired and greatly improves the battlefield effectiveness of the cannon.

FIGS. 4 and 5 Tables I and II provide a sample of modular compositions between A-Modules 12 and B-Modules 16. The tables show the total propellant power (zone) as well as the total number of units in a structure. For example, to compose a propellant power (zone) of 2 and ¾, referring to Table I, we need two A-Modules 12 and one B-Module 16.

The description hereinabove relates to some of the most important features which set and determine, inter alia, the structural parameters of the present invention. The operations of the present invention, under a best mode scenario, are discussed hereinbelow.

Module structure 10 shown in FIG. 1 is composed of six A-Modules, the total power of the structure is defined to be zone 6. Any shot on the zone 6 line 38 of FIG. 3 can be shot with this assembly of modules. The distance to the target and the TOF are given by the coordinates of the point along the axes. By pointing the gun low, a zone 6 shot can engage a target located 30 km away and the projectile will fly for approximately 78 seconds before impact; this is point 42 on FIG. 3. By raising the cannon's elevation angle slightly, zone 6 can be used to shoot at a target that is 35 km distant and the projectile will fly for approximately 100 seconds. This shot is labeled 44 on FIG. 3. Raising the cannon angle higher yet will result in a high trajectory shot like the "lob" of a tennis ball. Point 46 labels such a shot at a target that is 35 km from the gun; this zone 6 shot will fly for slightly under 140 seconds before impact. The "high" shot 46 and "low" shot 42 are both zone 6 shots at a target located 35 km away. The basic precept of the present invention includes that unitary and fractional modules may be combined to increase the number of zones that can be fired and hence increase the number of different trajectories (shots) that can be fired at a given target. A propellant system with only unitary modules is limited to the zones 32, hence only two different trajectories (points 44 and 46) can be used to attack a target that is 35 km away. A VIMAP system using modules in the ratio 3:4 adds additional zones 40. This doubles the number of trajectories that can be used to attack a target at 35 km, as the shots labeled 48 and 50 can be fired at such targets using zone 5¾.

FIG. 3 shows two shots (44 and 46) that can be fired at a target 35 km away using zone 6. The "high" shot 46 flies for about 140 seconds and the "low" one 44 flies for about 100 seconds. By firing the "high" shot 46 first then lowering the gun, and then firing the "low" shot 44 forty seconds later, both shots will arrive at the target simultaneously, achieving twice the destructive power of a single shot. Missions in which several shots are fired at a single target and timed to arrive at the same time are called "Multiple Round Simultaneous Impact" (MRSI) missions. By increasing the number of zones a cannon can fire, the present invention substantially increases its ability to fire MRSI missions.

Referring to FIG. 3, a system of unitary charges can fire only one trajectory 42 at a target that is 30 km away; this is a zone 6 trajectory. With such a unitary system, a MRSI mission cannot be fired at a target at the 30 km range. A VIMAP system using the ration 3:4 would add three zones between 5 and 6 and permit targets at the 30 km range to be attacked using any of 5 additional trajectories 52. With the system, a MRSI mission can be fired with the trajectories (52,42) timed so that six rounds would land simultaneously at the target.

FIG. 4, Table I shows the numerous total propellant power levels that can be composed from only two module sizes when the A-Module 12 is defined to have charge 1 and B-Module has charge ¾. FIG. 5, Table II shows the corresponding combinations when an A-Module 12 is defined to have charge 1 and a B-Module 16 has charge ⅔. Such combinations are required to permit a specific target at a specific range from the gun to be attached along several trajectories. Combustible case canisters 26 or rigid bags 27 (see FIG. 2) can be combined to form many different assemblies with varying amounts of total charge. More significantly, the canisters 26 which contain the charge of A-Modules 12 and B-Modules 16 are of the same physical dimensions. Thus, both modules use the same canister except that B-Module 16 canisters are filled with less propellant than A-Module 12 canisters. This feature provides an advantage of uniformity in physical size to thereby enable ease of manufacturing and handling.

The unicharge system in the current and proposed state of the art uses modules (canisters) of equal propellant power. The maximum size of an assembly of canisters depends upon the canister size and is limited by the constraints of the gun tube. One existing implementation uses assemblies of from 2 to 6 canisters, while another (using smaller canisters) uses from 2 to 8. Because the amount of propellant in a module is fixed at manufacture and because modules cannot be broken into smaller ones, this limits the number of different zones that can be fired, and amounts of propellant power equivalent to fractional module quantities are impossible. The VIMAP device and method needs modules built in only two different propellant power increments to enable the construction of assemblies with a desired level of propellant power. Under the best mode scenario declared herein, FIG. 4, Table I shows the variety of total power increments this invention provides when the module sizes are based on the integers 3 and 4. Per this table, an A-module 12 of unit propellant power and a B-Module 16 of ¾ the power of an A-Module provide nearly 4 times as many different zones (total amounts) of propellant power than existing systems which use only unitary A-Modules 16. FIG. 5, Table II, shows the diversity and proportionality that results from a system in which the module sizes are based on the integers 2 and 3. In FIG. 5, Table II, B-Modules 16 are defined to be ⅔ the power of A-Modules 12, and there are approximately 3 times as many zones possible than could be constructed only from A-Modules. This diversity and proportionality is because the present invention uses sequential integers to proportion and form the basis for the modules and their respective power levels.

The technique of composing charge assemblies from two sizes of modules manufactured so that their relative power is equivalent to the ratio of two successive integers is the key aspect of the present invention. FIG. 4, Table I, shows combinations derived from the integers 3 and 4; the power of a B-Module 16 is ¾ the power of an A-Module 12. An equivalent way of stating the same relation is to say that an A-Module 12 is ⅓ the power of a B-Module 16. FIG. 5, Table II, shows combinations derived from the integers 2 and 3. In FIG. 5, the power of a B-Module 16 is ⅔ the power of an A-Module 12. An equivalent way of stating this is that an A-Module 12 is ⅔ the power of a B-Module 16. Other systems of charge (not depicted) can be constructed from (for example) the integers 4 and 5, or 5 and 6, and so on. The large number of different combinations that can be achieved by this technique and the structural organizations resulting therefrom are conducive to Multiple Round Simultaneous Impact (MRSI) missions and enable variable power increments in a modular context.

While a preferred embodiment of the VIMAP has been shown and described, it will be appreciated that various changes and modifications may be made therein without departing from the spirit of the invention as defined by the scope of the appended claims.

What is claimed is:

1. A variable increment modular propellant system for firing a projectile from the barrel of a gun, said system comprising:

only first and second modules;

each of said first and second modules, having the same diameter and length;

said first module having a first propellant charge; and said second module having a second propellant charge which is a fraction of said first propellant charge; and said fraction being substantially equal to X divided by the quantity of X plus 1, where X represents said first propellant charge and is a whole integer greater than 1.

* * * * *